United States Patent [19]

Mimino et al.

[11] 3,940,267

[45] Feb. 24, 1976

[54] AUSTENITIC HEAT RESISTING STEEL

[75] Inventors: Tohru Mimino, Tokyo; Kazuhisa Kinoshita, Yokohama; Takayuki Shinoda, Tokyo; Isao Minegishi, Yokohama, all of Japan

[73] Assignee: Nippon Kokan Kabushiki Kaisha, Tokyo, Japan

[22] Filed: Feb. 28, 1975

[21] Appl. No.: 553,945

Related U.S. Application Data

[62] Division of Ser. No. 387,736, Aug. 13, 1973.

[52] U.S. Cl. ..... 75/128 G; 75/128 Z; 75/128 T

[51] Int. Cl.[2] ..... C22C 38/48; C22C 38/50

[58] Field of Search ..... 75/128 G, 128 Z, 128 T

[56] References Cited

UNITED STATES PATENTS

| | | | |
|---|---|---|---|
| 3,607,239 | 9/1971 | Mimino et al. | 75/128 T X |
| 3,716,353 | 2/1973 | Mimino et al. | 75/128 T X |
| 3,751,244 | 8/1973 | Mimino et al. | 75/128 T X |
| 3,795,509 | 3/1974 | Mimino et al. | 75/128 G X |

*Primary Examiner*—L. Dewayne Rutledge
*Assistant Examiner*—Arthur J. Steiner
*Attorney, Agent, or Firm*—William Anthony Drucker

[57] ABSTRACT

An austenitic heat resisting steel exhibiting excellent strength for a long period of time services at an elevated temperature, coexistant-adding 0.02 to 1.0% Nb and 0.02 to 1.9% Zr or 0.02 to 1.0% Nb, 0.02 to 1.0% Zr and 0.02 to 1.0% Ti in addition to usual composition of a stainless steel, simultaneously adjusting the atomic ratio of said(Nb+Zr) or (Nb+Zr+Ti) to C within the range of 0.05 to 1.0, preferably 0.2 to 0.5.

2 Claims, 1 Drawing Figure

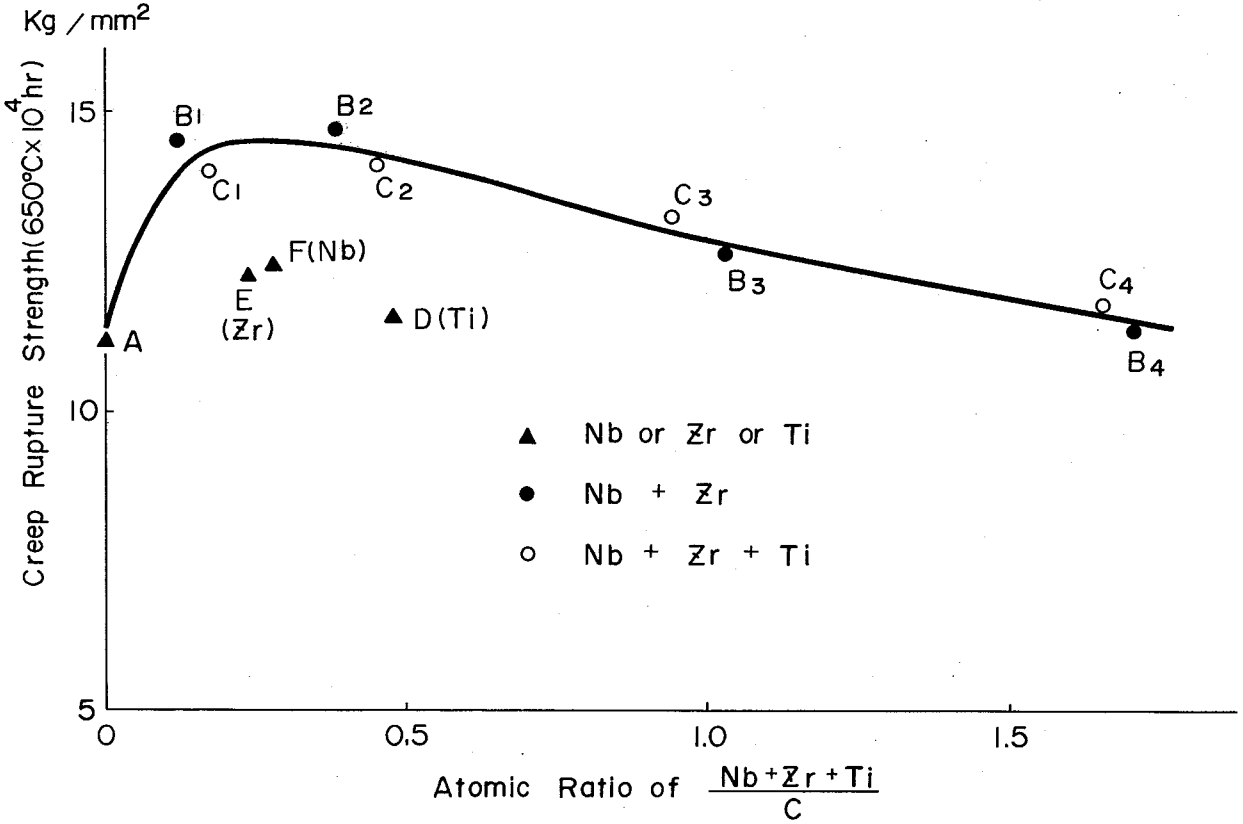
Creep Rupture Strength (650°C × 10⁴ hr)
Kg / mm²
15
10
5
0
0.5
1.0
1.5
Atomic Ratio of (Nb + Zr + Ti) / C
A
B1
C1
B2
C2
F(Nb)
E (Zr)
D(Ti)
C3
B3
C4
B4
Nb or Zr or Ti
Nb + Zr
Nb + Zr + Ti

AUSTENITIC HEAT RESISTING STEEL

This is a division of application Ser. No. 387,736 filed Aug. 13, 1973.

This invention relates to composition of improving heat resistance of austenitic heat resisting steel, and more particularly, strength for a long period time services at an elevated temperature.

It is well known that higher strength and better oxidation resistance of steel for long period of time at elevated temperature are required in some services such as tubings for boiler, chemical facilities and atomic power. For example, as the boiler becomes large-sized and ultracritical pressure typed, higher strength of employed steels has been called for said services.

At present, JIS (Japanese Industrial Standards) SUS-29 and SUS-43 steel (AISI-321 and 347 steel as similar standards) among 18Cr-8Ni austenitic stainless steels are generally employed for elevated temperature and high pressure services. In the above case, the feature of SUS-29 steel (AISI-321 steel) lies in that Ti is added in connection with C content and that og SUS-43 steel (AISI-347 steel), Nb is added in the same manner. These steels aimed at high temperature strength of more than 600°C. However, according to many experiments, it is evidently confirmed that said strength of the above steels is inferior to that of SUS-27 steel (AISI-304 steel) not containing Ti or Nb. That is, it is discovered that creep rupture strength of SUS-29 and 43 steel falls rapidly as servicing temperature becomes higher and employing time becomes longer. For example, said strength of SUS-27 steel at 700 C × $10^5$hr. is 4.3 Kg/mm$^2$, while both SUS-29 and 43 steel are 4 Kg/mm$^2$ in the same manner. It is presumed that this deterioration of said strength is due to that Ti and Nb carbide coalesces and precipitates in grain boundary during servicing for long period of time at higher temperature.

Thus, a heat resisting steel being inexpensive and having higher strength is not yet provided for industrial circles. It is a fact that development of some economical heat resisting steels is required today.

This invention has been developed in order to meet the above requirements. One of the features of this invention lies in that both Nb and Zr are simultaneously added in the range of which the atomic ratio of (Nb+Zr)/C is 0.05 to 1.0. Another feature of this invention lies in that Ti are further added to the above composition in the range which the atomic ratio of (Nb+Zr+Ti)/C is 0.05 to 1.0.

An object of this invention is to provide an economical heat resisting steel having higher strength and better heat resistance for long period of time at elevated temperature than those of ordinary stainless steels in the JIS, e.g. SUS-29 (AISI-321) or SUS-43 (AISI-347).

Another object of this invention is to provide a heat resisting steel having excellent heat resistance for long period of time at elevated temperature, which is based on synergestic effect depending upon the coexisting of (Nb+Zr) or (Nb+Zr+Ti).

Additional object of this invention will become apparent by the following description refering to the examples and the accompanying drawings, in which:

FIGURE is a diagram showing creep rupture strength of this invention steels arranged with the atomic ratio of (Nb+Zr+Ti)/C.

This invention steel has the following composition; that is,

C: 0.03 to 0.30% by weight
Si: up to 1.0% by weight
Mn: up to 2.00% by weight
Cr: 15.0 to 26.0% by weight
Ni: 7.0 to 22.0% by weight
the atomic ratio of (Nb+Zr)/C or (Nb+Zr+Ti)/C is from 0.05 to 1.0% respectively at the range of which Nb, Zr or Ti is from 0.02 to 1.0% respectively, unavoidable impurities and the balance being Fe.

As mentioned above, the reason for simultaneously adding said additional elements, i.e. coexistance of (Nb+Zr) or (Nb+Zr+Ti) in steel, lies in that the coexistance of these elements are effective for preventing formed carbides from coalescing and for causing said carbides to disperse uniformly. With this, the strength at an elevated temperature and for a long period of time service is improved remarkably. The fact that single addition of Nb, Zr, or Ti is very insufficient to improve said strength is made clear in many experiments based on the prior art. Therefore, the simultaneous addition as mentioned above, i.e. coexistance of these elements in steel, becomes an indispensable requirement of this invention. Such details will be apparent from the following examples.

TABLE

Chemical composition of tested steels is as follows.

| Steel | Chemical composition of tested steel (weight %) C | Si | Mn | Cr | Ni | Nb | Zr | Ti | (Nb+Ze+Ti)/c atomic ratio |
|---|---|---|---|---|---|---|---|---|---|
| A | 0.17 | 0.54 | 1.58 | 18.32 | 10.15 | — | — | — | — |
| B1 | 0.16 | 0.55 | 1.57 | 18.09 | 10.10 | 0.090 | 0.066 | — | 0.12 |
| B2 | 0.15 | 0.57 | 1.56 | 17.89 | 9.92 | 0.191 | 0.238 | — | 0.38 |
| B3 | 0.16 | 0.59 | 1.51 | 17.95 | 9.98 | 0.655 | 0.606 | — | 1.03 |
| C1 | 0.16 | 0.56 | 1.60 | 18.04 | 10.01 | 0.097 | 0.027 | 0.047 | 0.17 |
| C2 | 0.17 | 0.55 | 1.55 | 17.81 | 9.92 | 0.308 | 0.114 | 0.089 | 0.45 |
| C3 | 0.16 | 0.55 | 1.54 | 18.25 | 9.83 | 0.601 | 0.202 | 0.181 | 0.94 |
| B4 | 0.15 | 0.58 | 1.55 | 17.80 | 10.11 | 0.99 | 0.98 | — | 1.71 |
| C4 | 0.15 | 0.57 | 1.45 | 18.02 | 9.89 | 1.01 | 0.32 | 0.30 | 1.65 |
| CD | 0.15 | 0.51 | 1.59 | 17.65 | 9.58 | — | — | 0.29 | 0.48 |
| E | 0.14 | 0.55 | 1.41 | 18.20 | 9.86 | — | 0.25 | — | 0.24 |
| F | 0.15 | 0.53 | 1.58 | 17.54 | 10.10 | 0.33 | — | — | 0.28 |

These steels are hot-rolled to the thickness of 12 mm and then are subjected to solution treatment of being heated-up to 1,100°C and soaked at the same temperature for 1 hr, then water-quenched. The results of creep rupture test by ordinary test pieces cut off from the above-mentioned plates are shown in Table II and the changes of said creep rupture strength at 650°C × $10^4$ hr. depending upon said atomic ratio is shown in the accompanying drawing.

TABLE II

| Steel | Creep rupture strength of tested steels (Kg/mm²) 650°C $10^3$hr | 650°C $10^4$hr | 700°C $10^3$hr | 700°C $10^4$hr |
|---|---|---|---|---|
| A | 15.0 | 11.2 | 9.7 | 7.1 |
| B1 | 18.5 | 14.5 | 11.4 | 8.6 |
| B2 | 19.0 | 14.7 | 11.7 | 9.0 |
| B3 | 16.8 | 12.7 | 10.9 | 8.0 |
| C1 | 18.0 | 14.0 | 12.4 | 9.2 |
| C2 | 18.0 | 14.1 | 12.2 | 9.2 |
| C3 | 17.4 | 13.2 | 10.5 | 8.2 |
| B4 | 15.1 | 11.5 | 9.9 | 7.3 |
| C4 | 15.5 | 11.7 | 10.2 | 7.6 |
| D | 15.3 | 11.6 | 9.5 | 7.0 |
| E | 16.2 | 12.3 | 10.3 | 7.5 |
| F | 6.5 | 12.4 | 10.5 | 7.4 |

These steels are grouped together with a usual stainless steel-(steel A), coexisting steels of (Nb+Zr)-(steel B1–B4), coexisting steels of (Nb+Zr+Ti)-(steel C1–C4) and single-added steels of Nb, Zr or Ti-(steel D, E and F). According to the above Tables I and II, it will be well understood that the change of said neat resistance for a long period of time services at an elevated temperature depends upon the composition, specially, how the selected elements, i.e. Nb, Zr or Ti, are added and what the atomic ratio of the said elements to carbon is. That is, first, said strength of a usual stainless steel, i.e. steel A is too low for a long period of time services at an elevated temperature. Secondly, said strength of the single-added steel of Nb, Zr, or Ti, i.e. steel D, E and F, is little improved for said services. Thirdly, the coexisting steels of (Nb+Zr), i.e. steel B1–B3, and of (Nb+Zr+Ti), i.e. C1–C3, exhibit superior strength in comparison with other steels, i.e. steels A, D, E and F. Fourthly, said strength of steels in which said atomic ratio of (Nb+Zr) or (Nb+Zr+Ti) to C exceeds 1.0, i.e. steel B4 and C4, are as low as that of steels A, D, E and F, evenif (Nb+Zr) or (Nb+Ti) is coexistently added. It is understood from the above results that the coexisting condition of (Nb+Zr) or (Nb+Zr+Ti) in steel should be adjusted to the most suitable range. Such a range is selected from the scope that the atomic ratio of (Nb+Zr) or (Nb+Zr+Ti) to C, wherein C is 0.03 to 0.30% and Nb, Zr or Ti is 0.02 to 1.0% respectively, is from 0.05 to 1.0, preferably 0.2 to 0.5 as shown in the drawing.

The reason why the most suitable range is set up in the present invention is as follows.

C: C content of this invention is selected from 0.03 to 0.3%. Actually, it should be decided in connection with the later-mentioned atomic ratio. In such a case, Cr carbide is possible to be made to precipitate and disperse around Nb and Zr or Nb, Zr and Ti carbides without any coalescence bringing about the lowering of said strength. This behavior results in improvement of said heat resistance for a long period of time service at an elevated temperature.

Cr: less than 15.0% Cr brings about a change of oxidizing resistance for the worse, while more than 26.0% Cr becomes apt to be hard to get stabilizing austenitic phase.

Ni: 7.0 to 22.0% Ni is substantially selected in connection with the above Cr content.

Si: and Mn: These elements are enough to be in the usual range of stainless steel.

Nb, Zr or Ti: These elements are added in steel with a coexisting manner of (Nb+Zr) or (Nb+Zr+Ti). On such a case, content of each of said elements is selected from the range of 0.02 to 1.0% in connection with the above C content. Such a selection depends upon the later-mentioned atomic ratio of (Nb+Zr) or (Nb+Zr+Ti) to C.

Atomic ratio: said heat resistance for a long period of time services at an elevated temperature is dependent upon the atomic ratio of (Nb+Zr) or (Nb+Zr+Ti) to C in steel. Said atomic ratio is calculated with the following formula:

$$\text{Atomic Ratio} = \left(\frac{\text{Nb wt\%}}{\text{Nb atomic wt}} + \frac{\text{Zr wt\%}}{\text{Zr atomic wt}}\right) / \frac{\text{C wt\%}}{\text{C atomic wt}}$$

When weight % and atomic weight of each of C, Nb and Zr are substituted in the above formula, the required atomic ratio can be easily obtained. In the present invention, said atomic ratio must be adjusted within the range of 0.05 to 1.0, preferably 0.2 to 0.5. In other words, said content of C, Nb and Zr should be selected from the abovementioned range to obtain the required atomic ratio. It is needless to say that said atomic ratio of (Nb+Zr+Ti) to C is also calculated with the same manner. The atomic ratio also may be substituted with the weight ratio of (Nb+Zr) or (Nb+Zr+Ti) to C. In such a case, said weight ratio is calculated with the following formula and becomes frow 0.4 to 8.0 in correspondence with said atomic ratio of 0.05 to 1.0.

$$\text{Weight Ratio} = \frac{\text{Nb wt\%} + \text{Zr wt\%}}{\text{C wt\%}} = 0.4 - 8.0$$

That is, said atomic ratio of 0.05 to 1.0 is equal to said weight ratio of 0.4 to 8.0.

A steel plate having the above-mentioned composition is prepared by hot or cold working after usual steel making. The obtained plate should be heated up to 1050°C or more and soaked for at least 10 min, then is water-quenched. With the above process, carbides and nitrides of Nb, Zr and Ti are solution-treated into matrix of said steel, simultaneously, the grain size is adjusted to N 0.4 to 0.8 of ASTM.

Thus, when a steel is prepared as mentioned above and interrelation among C, Nb, Zr and Ti is adjusted to the scope of said atomic ratio or said weight ratio, excellent heat resistance for a long period of time at an elevated temperature can be obtained with stability and ease.

We claim:

1. An austenitic heat resisting steel exhibiting excellent strength for a long period of time services at an elevated temperature consisting of the following composition;

C: 0.03 to 0.30%, Si: up to 1.00%,
Mn: up to 2.00%, Cr: 15.0 to 26.0%,
Ni: 7.0 to 22.0%.
0.02 to 1% of each of Nb(containing Ta) and Zr wherein the atomic ratio of (Nb+Zr) to C is within the range of 0.05 to 1.0, preferably 0.2 to 0.5 unavoidable impurities and the balance being Fe.

2. An austenitic heat resisting steel exhibiting excellent strength for a long period of time services at an elevated temperature consisting of the following composition:

C: 0.03 to 0.30%, Si: up to 1.00%,
Mn: up to 2.00%, Cr: 15.0 to 26.0%.
Ni: 7.0 to 22.0%
0.02 to 1 % of each of Nb (containing Ta), Zr and Ti wherein the atomic ratio of (Nb+Zr+Ti) to C is within the range of 0.05 to 1.0, preferably, 0.2 to 0.5 unavoidable impurities and the balance being Fe.

* * * * *